United States Patent [19]

Leutner et al.

[11] 4,429,619

[45] Feb. 7, 1984

[54] CONTROL SYSTEM FOR A HYDRAULIC LOAD

[76] Inventors: Volkmar Leutner, Birkbuschstr. 11, 7251 Friolzheim; Berthold Pfuhl, Graf-Hartmann-Str. 65, 7145 Markgröningen, both of Fed. Rep. of Germany

[21] Appl. No.: 137,987

[22] Filed: Apr. 4, 1980

[30] Foreign Application Priority Data

May 12, 1979 [DE] Fed. Rep. of Germany ..... 2919206

[51] Int. Cl.[3] ..... F15B 13/042

[52] U.S. Cl. ..... 91/29; 137/100; 137/110; 91/31

[58] Field of Search ..... 91/28, 29, 31; 137/110, 137/100

[56] References Cited

U.S. PATENT DOCUMENTS

Re. 30,403 9/1980 Bitonti ..... 137/110 X
3,550,505 12/1970 Byers ..... 60/422 X
3,776,098 12/1973 Behrens et al. ..... 91/29

FOREIGN PATENT DOCUMENTS 537572 3/1922 France ..... 137/100
286818 3/1928 United Kingdom .
601866 5/1948 United Kingdom ..... 91/29

*Primary Examiner*—George L. Walton

[57] ABSTRACT

A hydraulic control circuit for a cylinder-and-piston unit includes a relatively small electrohydraulically operated servo-control valve, a main pressure conduit including a measuring throttle, an auxiliary control valve cooperating with an additional pressure conduit connected parallel to the main pressure conduit to branch the pressure fluid in response to a predetermined level of pressure difference occurring across the measuring throttle. In this manner the servo-control valve can control a system of pressure fluid which is substantially larger than the nominal flow rate of the servo-control valve.

12 Claims, 4 Drawing Figures

CONTROL SYSTEM FOR A HYDRAULIC LOAD

BACKGROUND OF THE INVENTION

The present invention relates in general to a system for controlling a hydraulic load, and in particular to a system which includes a source of pressure fluid, a pressure conduit connecting the source to the load and an electrohydraulically operated servo-control valve arranged in the pressure conduit.

A hydraulic control system of this type is known from the German published patent application No. 23 64 559 in which it is disclosed how an extrusion cylinder of a die casting machine for plastic materials is supplied with a pressure fluid via an electrohydraulic servo-control valve. Particularly in such control systems which are used in connection with die casting machines for plastic material it is necessary that during the filling phase of the process the servo-control valve adjust the system to feed through the extrusion cylinder a considerably increased amount of pressure fluid at a low pressure drop in the control valve whereas in the subsequent compression phase only small amounts of pressure fluid must be supplied. The servo-control valve permits that the pressure fluid flowing to the extrusion cylinder can be very accurately controlled in a broad range of its pressure and quantity. Nevertheless, the disadvantage of this known control system is the fact that the nominal flow rate of the servo-control valve has to be adjusted to the largest amount of the pressure fluid that still would cause a small permissible pressure drop across the valve. As a consequence, the prior art control system of this type are relatively expensive and as much they require large and expensive servo-control valves. In addition, when large servo-control valves are employed, the accuracy of the control of the pressure fluid decreases proportionately to the decrease of the pressure fluid flow.

From the U.S. Pat. No. 3,550,505 a device for controlling a hydraulic load is also known in which a throttle is connected in a pressure conduit between a pressure fluid source and a multiway control valve and the resulting pressure difference of the throttle controls an auxiliary control valve. The effect of this known combination of a throttle with an auxiliary valve and additional structural elements is limited to a device having a single pump and two separate load circuits whereby the purpose of this combination is to control the dual loads independently from each other. In addition, even in this known device the normal flow rate of the multiway control valve has to be adjusted to the maximum amount of the pressure fluid which has to be supplied to the load.

SUMMARY OF THE INVENTION

It is therefore a general object of the present invention to overcome the aforementioned disadvantages.

More particularly, it is an object of the invention to provide an improved hydraulic control system which enables to control proportionally to an electrical control signal such an amount of pressure fluid which exceeds the nominal flow rate of the employed servo-control valve.

Another object of this invention is to provide such an improved hydraulic control system in which the accuracy and the speed of the response of the servo-control valve can be fully utilized even in the range of small control signals.

An additional object of the invention is to provide such an improved hydraulic control system in which the auxiliary control elements necessary for supplementing the main servo-control valve are substantially lower in cost than the price difference between a large and a small servo-control valve.

In keeping with these objects and others which will become apparent hereafter, one feature of the invention resides, in a hydraulic control system of the above-described type, in the provision of a measuring throttle connected in the pressure conduit between the source and the main control valve, an auxiliary pressure control circuit including an auxiliary control valve having a spring bias slider, two end spaces at respective ends of the slider and an intermediate control space communicating with the load via a parallel pressure conduit, a first branch conduit connected between the inlet of the measuring throttle and one end space of the auxiliary valve, and a second branch conduit connected between the outlet of the measuring throttle and the other end space of the auxiliary valve to control its slider in response to pressure differences across the measuring throttle.

In the preferred embodiment of this invention, the electrohydraulically operated main control valve is a proportional control valve the sliding element of which is directly or indirectly displaced proportionally to an electric control signal applied to control solenoids. In this manner a large starting speed and only a small drive-in speed of the working element of the load circuit can be achieved. Furthermore, in the preferred embodiment the auxiliary control valve is in the form of a two-way control valve in which the biasing spring is arranged in one of the end spaces of the valve body to displace the slider into a starting position in which the pressure fluid flowing into the other end space is blocked and only in response to the pressure difference across the measuring throttle the pressure fluid from the other end space is discharged into the intermediate control space proportionally to the pressure difference. In this embodiment, the hydraulic load can achieve a high speed of its rapid return motion in both directions.

Other features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
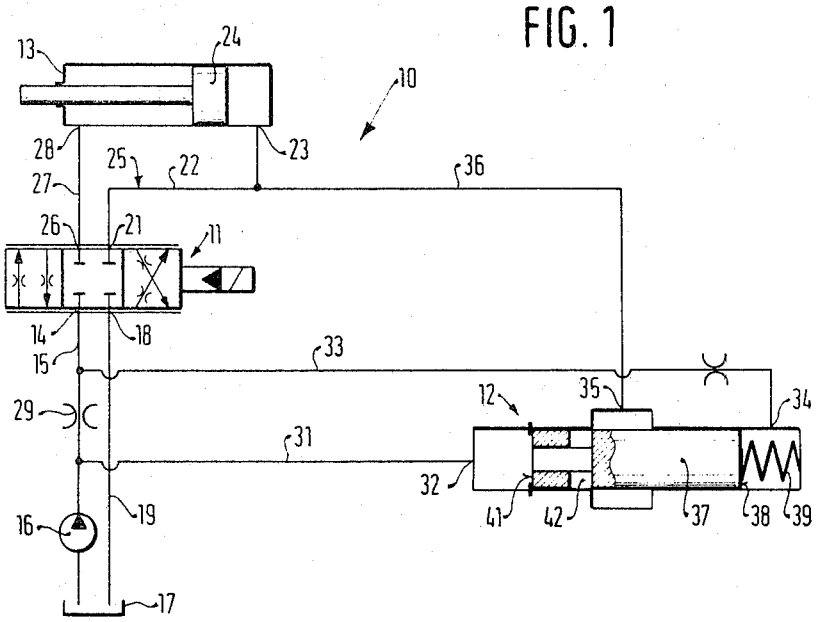
FIG. 1 is a simplified circuit diagram of a first embodiment of the control system for a hydraulic load.

Referring firstly to FIG. 1, the hydraulic control system 10 is composed essentially of an electrohydraulically operated servo-control valve 11, an auxiliary control valve 12 and a load in the form of a two-way cylinder-and-piston unit 13. An inlet port 14 of the control valve 11 is connected via a section 15 of a pressure conduit of a circuit 25 to an outlet of a pump 16 which delivers pressure fluid from a tank 17. A return port 18 of the control valve 11 communicates with the tank 17 via a return fluid conduit 19. The juxtaposed ports 26 and 21 of the control valve 11 are connected respectively via sections 27 and 22 of the conduit circuit 25 to the ports 28 and 23 of the cylinder-and-piston unit 13. The port 23 communicates with a pressure space in the unit 13 which is bounded by the large effective surface of the piston 24 of the unit 13. In one working position of the control valve 11, the pressure conduit section 15 and the conduit section 22 deliver pressure fluid from the pump 16 into the port 23 whereas the fluid from the port 28 is returned via conduit sections 27 and 19 into the tank. In another working position of the valve 11 the pressure fluid supply and return with respect to ports 28 and 23 of the load unit 13, are reversed.

In the pressure conduit section 15 is arranged a measuring throttle 29. Downstream of the throttle 29 is connected a first branch conduit 33 leading to an intake port 34 of a control space at one end of the auxiliary control valve 12. Upstream of the throttle 29 there is connected another branch conduit 31 leading to intake port 32 to a second space at the opposite end of the auxiliary valve 12. The valve 12 has further an intermediate outlet port 35 connected via a pressure conduit 36 to the section 22 of the conduit circuit 25. The auxiliary control valve 12 has a reciprocating control spool or slider 37 one end of which facing the intake port 34 is spring biased by a pressure spring 39 and in addition is acted upon by pressure fluid from the inlet 34. The opposite end face of the slider 37 facing the intake port 32 is acted upon by the pressure fluid from the conduit 31 upstream of the throttle 29. The biasing spring 39 normally keeps the slider 37 in its rest position as illustrated in FIG. 1; in this rest position the communication between the intake port 32 and the outlet port 35 is interrupted. As soon as a pressure difference occurs across the measuring throttle 29, the slider 37 is moved against the force of the spring 39 into a regulating position in which the pressure fluid from the intake port 32 passes through the control opening 42 in an amount which is proportional to the displacement of the slider into an intermediate control chamber, and therefrom via the outlet port 35 the fluid is discharged into the conduit 36.

The operation of hydraulic control system 10 is as follows:

When the control member of the servo-control valve 11 is in its central position as indicated in the drawing and also if the slider 37 of the auxiliary control valve 12 is in its illustrated position, the working piston 24 of the cylinder-and-piston unit 13 is hydraulically blocked. If now the control spool of the servo-control valve 11 is moved to the left into a switching position in which the intake port 14 is connected to the outlet port 21 of the valve, the pressure fluid from the pump 16 now flows through the conduit section 22 and through the intake port 23 into the right hand pressure space of the load unit 13. The flow of the pressure fluid flowing into the unit 13 generates a pressure difference across the measuring throttle 29 and this difference affects via the branch conduits 31 and 33 the slider 37 of the auxiliary control valve 12. If this pressure difference on the throttle 29 exceeds a certain value defined by the spring 39 and by the extent of overlapping of the control edge of the slider 37, the latter moves against the biasing spring and opens the passage between the inlet port 32 and the outlet port 35 proportionately to the magnitude of the pressure difference. As a consequence, parallel to the main pressure fluid stream flowing through the servo-control valve 11 to the port 23 of the working cylinder 13, an additional stream of pressure fluid flows from the pump 16 via the discharge conduit 36 to the intake port 23 of the cylinder 13. The servo-control valve 11 therefore can control proportionally to an electrical signal a stream of pressure fluid which is considerably larger than the nominal flow rate of the relatively small control valve 11. If on the other hand, only a small stream of pressure fluid is fed to the cylinder-and-piston unit 13, the parallel conduit connection via the auxiliary valve 12 is blocked by the slider 37 and the entire pressure fluid stream flows through the pressure conduit 22 and therefore the high accuracy of the relatively small servo-control valve 11 can be fully utilized. The fluid return stream from the left hand pressure space in the cylinder 13 is due to the reduced size of its effective piston area which supports the piston rod so small that the return stream can be discharged through the control valve 11 into the return conduit 19 without any auxiliary devices.

If the servo-control valve 11 is moved to the right in to its reverse working position, the pressure fluid delivered by the pump 16 flows through the pressure conduit section 15 and the control valve 11 into the pressure conduit section 27 and therefrom into the intake port 28 of the cylinder unit 13 so that the working piston 24 moves toward the other port 23. Pressure oil from the right hand pressure space of the cylinder unit 13 is now discharged through the port 23, conduit section 22, control valve 11 and the return conduit 19 into the tank 17. The control passages of the control valve 11 and the measuring throttle 29 are adjusted such that during the movement of the load piston 24 to the right the pressure difference resulting across the measuring throttle 29 is insufficient for opening the auxiliary control valve 12. As a consequence, a relatively low speed of the retraction movement of the piston 24 in the cylinder 13 takes place as it is desired in the operation of extrusion cylinders of a die casting machine for plastic materials.

Figure 2:
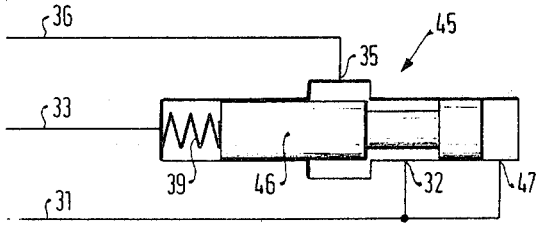
FIG. 2 shows a modification of the auxiliary control valve in the system of FIG. 1.

FIG. 2 shows a modification 45 of the auxiliary control valve 12 of FIG. 1 connectable to branch conduits 31 and 33 and to the parallel conduit 36. The auxiliary control valve 45 differs from that of FIG. 1 in the provision of two inlet parts 32 and 47 whereby the port 47 communicates with the end space at the outer side of the valve piston 46 whereas the port 32 communicates with an intermediate control space. In this embodiment, the piston 46 is made without the passage between the end and intermediate control spaces. The operation of this modified version of the auxiliary control valve is substantially the same as that in FIG. 1 and controls in the same manner the flow of pressure fluid from the branch conduit 31 into the parallel pressure conduit 36 proportionally to the pressure difference occurring across the measuring throttle 29.

Figure 3:
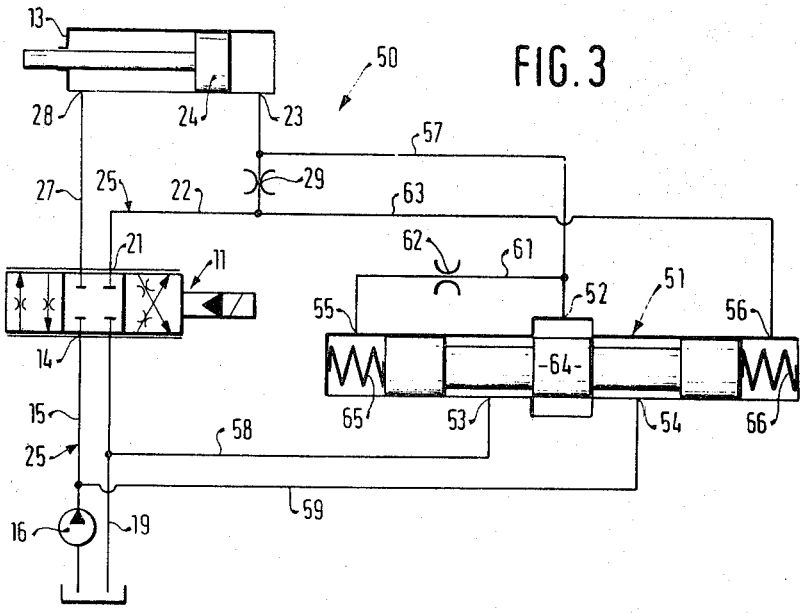
FIG. 3 shows a modification of the system of FIG. 1.

FIG. 3 shows another embodiment 50 of the hydraulic control system of this invention. In this embodiment, the component parts corresponding to those of FIG. 1 are designated by like reference numerals. The difference between the system 50 and the system 10 of FIG. 1 is particularly in the arrangement of the measuring throttle 29 in the pressure conduit section 22 between the multiway control valve 11, and the intake port 23 of the working cylinder 13. The auxiliary control valve 51 has two control ports 55 and 56, a return port 53, a feeding port 54 and a discharge port 52. The discharge port 52 is connected via a parallel conduit 57 to the intake port 23 of the working cylinder 13 and is thus connected downstream of the measuring throttle 29. The return port 53 of the auxiliary valve 51 is connected via conduit 58 to the return conduit 19 of the pressure fluid circuit 25. The feeding conduit 54 communicates via a connecting conduit 59 with the main pressure conduit section 15 at the outlet of the pump 16. The discharge port 52 and thus the downstream end of the measuring throttle 29 is connected via a control conduit 61 and an attenuating throttle 63 to the first control port 55. The pressure conduit section 22 between the servo-control valve 11 and the upstream end of the measuring throttle 29 branches into a second control conduit 63 which is connected to the second control port 56 of the auxiliary valve 51. In this embodiment, the auxiliary valve 51 has a slider which is centered into its normal center position by two biasing springs 65 and 66. In this central position of the slider the communication between respective ports 52, 53 and 54 is blocked.

The operation of the hydraulic control system 50 is as follows: If the control slides of the servo-control valve 11 and of the auxiliary control valve 51 are in their neutral positions as illustrated in FIG. 3, the working piston 24 of the cylinder-and-piston unit 13 is hydraulically blocked. When the spool or slide of the servo-control valve 11 is moved into its right hand switching position as indicated by crossed connecting channels in FIG. 3, the pump 16 delivers pressure fluid through the pressure conduit 25 to the right hand intake port 23 of the cylinder-and-piston unit 13. This stream of pressure fluid generates a pressure difference across the measuring throttle 29 which via the conduits 57, 61 and 63 is applied through the control ports 55 and 56 against the end spaces of the auxiliary slider 64. As soon as the slider of the servo-control valve 11 is displaced so far that the pressure difference on the measuring throttle 29 exceeds a predetermined magnitude, this pressure difference starts moving the auxiliary slide 64 to the left against the force of biasing spring 65. In doing so, the control edge of slide 54 opens a passage from the feeding port 54 to the discharge port 52 and an additional stream of pressure fluid starts flowing through conduits 59 and 57 to the intake port 23 of the cylinder 13 parallel to the main pressure fluid stream through the circuit 25. The magnitude of this additional pressure fluid stream through the auxiliary valve 51 is proportional to the magnitude of the pressure difference on the throttle 29. Similarly as in the preceding example, the relatively small servo-control valve can control a stream of pressure fluid flowing to the intake ports of working cylinder 13 in response to an analogous electrical control signal applied to the electrically operated solenoids of the servo-control valve 11. This analogue pressure fluid stream can be substantially larger than the nominal value of the maximum permissible through-flow rate to the servo-control valve 11. In addition, in the case when the servo-control valve 11 controls only small streams of pressure fluids and the slider 64 of the auxiliary valve 51 resumes its blocking central position, the high accuracy of the small servo-control valve 11 is now fully utilized.

It it is desired to move the load or working piston 24 to the right (FIG. 3) the control slide of the servo-control valve 11 is moved to the right to attain its left hand switching position in which the pump 16 delivers pressure fluid through the pressure conduit sections 15 and 27 to the opposite intake port 28 of the cylinder and piston unit 13. During the movement of the working piston 24 to the right, the pressure oil from the right hand pressure space flows now through the port 23, conduit section 22, servo-control valve 11 and the return conduit 19 into the tank 17. If during this return flow the pressure difference across the measuring throttle 29 is below the aforementioned predtermined value, the auxiliary slider 64 remains in its central position in which the discharge port 22 is blocked. On the other hand, if the pressure difference on throttle 29 exceeds its predetermined value, the higher pressure is applied via conduit 27 and 61 and the intake port 55 of the auxiliary valve 51 and consequently the auxiliary slider 64 is moved to the right against the biasing spring 66 and opens a control passage between the ports 52 and 53. As a consequence, additionally to the main stream of return fluid flowing from the working cylinder 13 via the servo-control valve 11 into the tank there is established via the conduit 57, the auxiliary valve 51 and the conduit 58, another return stream to the tank 17 parallel to the main return stream. In contrast to the system of FIG. 1, the hydraulic control system 50 provides for a high speed of movement of the piston 24 not only during the outward movement of the piston rod but also during the inward movement of the latter.

Figure 4:
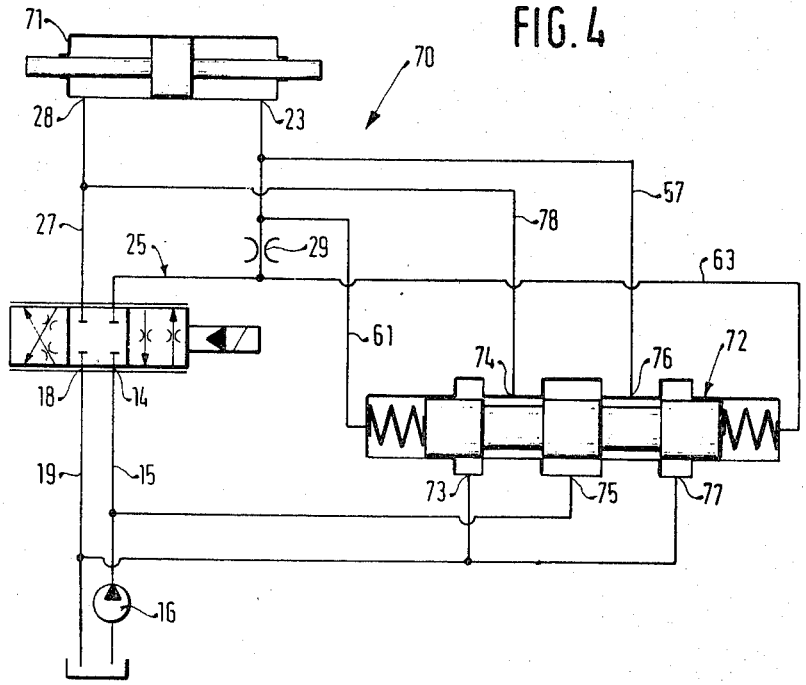
FIG. 4 is still another modification of the system of FIG. 1.

FIG. 4 illustrates still another embodiment 70 of the hydraulic control system of this invention whereby like complement parts with respect to the embodiment of FIG. 3, are designated by like reference numerals. The control 70 has a cylinder-and-piston unit 71 in which the opposite end surfaces of its working piston are equal. The auxiliary control valve 72 is modified in such a manner that apart from the two control ports 55 and 56 there are provided five intermediate ports 73 through 77, namely a central feeding port 75, two load ports 74 and 76, and two return ports 73 and 77. The feeding port 75 and the return ports 73 and 77 are connected respectively to pressure conduit sections 15 and to the return conduit 19. One load port 76 of the auxiliary valve 72 is connected via the conduit 57 to the inlet port 23 of the working cylinder 71 and the other load port 74 of the auxiliary valve is connected to conduit 78 through the other port 28 of the cylinder 71.

The operation of this embodiment 70 of the hydraulic control circuit corresponds substantially to the preceding embodiment 50 according to FIG. 3 and similarly as the latter circuit, it also enables rapid outward movements as well as rapid inward movements of the piston of the cylinder unit 71. As mentioned above, the effective surfaces of the piston of the unit 71 have the same size and therefore provide for a uniform movement in both working directions.

It will be understood that each of the elements discussed above, or two or more together, may also find a useful application in other types of construction differing from the type described above.

While the invention has illustrated and described as embodied in connection with a two-way working cylinder, it is not intended to be limited to the details shown, since various modifications and structural changes may be made without departing in any way from the spirit of the present invention.

For example, the hydraulic control circuit of this invention can be also applied for one-way loads or for hydromotors. The servo-control valve can be of any suitable commercially available construction and can be devised either as a one-stage or a multistage unit or a proportional electromagnetically operated valve. Similarly, the construction of the auxiliary control valves can be of different types for performing the regulating function.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A control system for a hydraulic load, including a source of pressure fluid, at least one intake port to the load, at least one pressure conduit for connecting the source to the intake port and an electrohydraulically operated main control valve arranged in said pressure conduit to direct the pressure fluid to said hydraulic load, said system comprising a measuring throttle connected in said pressure conduit; an auxiliary circuit including an auxiliary control valve having a slider; two end spaces cooperating respectively with the ends of said slider and an intermediate control space connected to said intake port in parallel with said measuring throttle and said main control valve in said pressure conduit; a biasing spring within one of said two end spaces for unilaterally adjusting the slider into a flow blocking rest position; a first branch conduit connected between the inlet of said measuring throttle and one space of said auxiliary valve; a second branch conduit connected between the outlet of said measuring throttle and the other end space of said auxiliary valve and when pressure differences across said measuring throttle is low, some of the pressure fluid is directed through the first branch to maintain the slider in the flow blocking rest position and when pressure differences across said measuring throttle is high, some of the pressure fluid is directed through the second branch to move the slider from the flow blocking rest position to an open position to allow some of the pressure fluid through the slider to the hydraulic load which controls said slider in proportion to pressure differences across said measuring throttle to maintain the hydraulic load in a fixed position.

2. A system as defined in claim 1, wherein said electrohydraulically operated main control valve is a servo-control valve.

3. A system as defined in claim 1, wherein said electrohydraulically operated main control valve is a proportional valve having a slider controlled by solenoids proportionally to an input electrical signal.

4. A system as defined in claim 1, wherein said measuring throttle is connected in said pressure conduit between said source and said main control valve.

5. A system as defined in claim 4, wherein said auxiliary control valve is a two-way control valve, said biasing spring being adjusted to a predetermined pressure difference across said measuring throttle.

6. A system as defined in claim 1 wherein said load includes a pressure relieving port and said measuring throttle is arranged in said pressure conduit between said main control valve and said intake port of the load.

7. A system as defined in claim 6, wherein said auxiliary control valve is a three-way control valve having a slider which is spring biased at each end into a central flow blocking position and being provided with additional ports, one of said additional ports being connected to the outlet of said pump and the other additional port being connected to a tank whereby said intermediate control space communicates via an additional throttle with one of said end spaces.

8. A system as defined in claim 7, wherein said load is a cylinder-and-piston unit having a differential piston and two ports at each side of the piston whereby the port communicating with a larger side of the piston is connected to said measuring throttle and to said intermediate space of the auxiliary control valve.

9. A system as defined in claim 8, wherein the main control valve, the auxiliary control valve and the measuring throttle are arranged in a common housing.

10. A system as defined in claim 6, wherein said auxiliary control is a multiway control valve having a slider which is spring biased at each end thereof into a central flow blocking position, two additional ports connected to respective ports of said cylinder-and-piston unit, an additional feeding port and an additional return port connected respectively to said pressure conduit and to a tank.

11. A system as defined in claim 10, wherein said cylinder-and-piston unit is a two-way unit having a working piston defining equal effective working areas.

12. A system as defined in claim 1, wherein said load is a cylinder-and-piston unit the cylinder of which is an extrusion cylinder of a die casting machine for plastic materials.

* * * * *